US006131585A

United States Patent [19]

Reinstein et al.

[11] Patent Number: 6,131,585

[45] Date of Patent: Oct. 17, 2000

[54] HAIR ORNAMENT ATTACHMENT SYSTEM

[75] Inventors: David Reinstein, El Segundo; Melody Kulp, Los Angeles, both of Calif.

[73] Assignee: Mellies, LLC, El Segundo, Calif.

[21] Appl. No.: 09/426,988

[22] Filed: Oct. 26, 1999

Related U.S. Application Data

[63] Continuation-in-part of application No. 09/275,926, Mar. 24, 1999, abandoned.

[51] Int. Cl.[7] ..... A45D 8/12

[52] U.S. Cl. ..... 132/275; 132/273

[58] Field of Search ..... 132/275, 273, 132/276, 277, 278, 279, 200; 2/196, 199, 209.1, DIG. 6; 446/372, 374, 378, 379, 380, 382; 63/8, 20, DIG. 1; 211/85.2, 40, 13

[56] References Cited

U.S. PATENT DOCUMENTS

| | | | |
|---|---|---|---|
| 48,677 | 7/1865 | Grant et al. | 132/275 |
| 2,334,937 | 11/1943 | Fair | 132/275 |
| 4,406,296 | 9/1983 | Wexler et al. | 132/273 |
| 4,912,944 | 4/1990 | Crosley et al. | 132/275 |
| 5,671,849 | 9/1997 | Bacon | 211/13 |
| 5,822,798 | 10/1998 | Baxcley | 132/273 |
| 5,899,211 | 5/1999 | Brown | 132/273 |

*Primary Examiner*—Pedro Philogene
*Attorney, Agent, or Firm*—Cislo & Thomas LLP

[57] ABSTRACT

A hair ornament attachment system includes a hair ornament having a decorative silk flower side and a back side to which the hook portion of a Velcro® fastener is adhered. Alternatively, the hair ornament decorative side may consist of a piece of plastic formed to resemble a rare gemstone. The hair ornaments are small and lightweight, and the hook fastener portion may be intertwined in a user's hair thereby attaching the ornament for adornment. The attachment system also includes a display comprising a loop fastening area supported by a staff framework, to attractively store the ornaments not in use. Additionally, drop or dangling hair ornamentation includes a fibered material (on which beads may be strung), having one or both ends mounted to a two-sided hook portion which similarly may be intertwined into the user's hair.

7 Claims, 4 Drawing Sheets

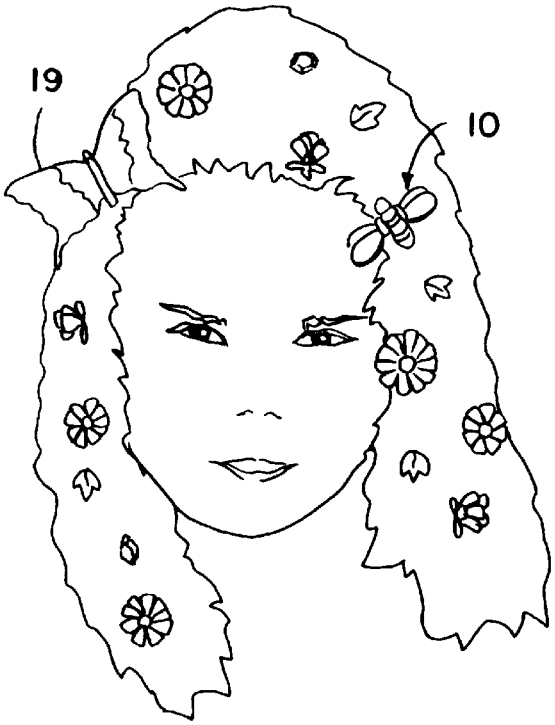
FIG. 1
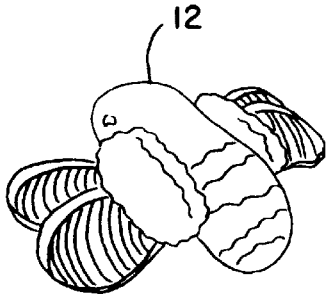
FIG. 2
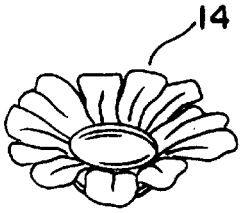
FIG. 3
FIG. 6
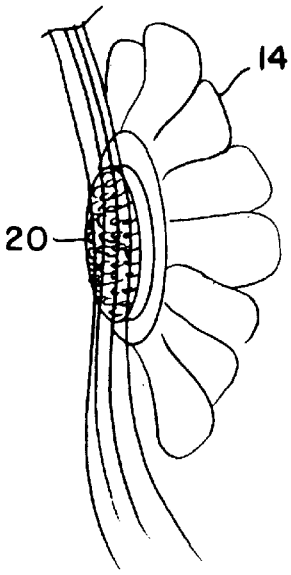
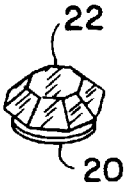
FIG. 4
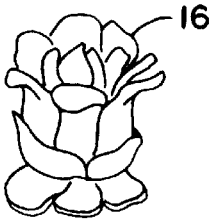
FIG. 5

HAIR ORNAMENT ATTACHMENT SYSTEM

CROSS-REFERENCES TO RELATED APPLICATIONS

This application is a continuation-in-part for U.S. patent application Ser. No. 09/275,926, filed Mar. 24, 1999, now abandoned.

BACKGROUND OF THE INVENTION

1. Field of the Invention

This invention relates generally to fashion accessories, and more particularly to lightweight ornaments directly attachable to a user's hair.

2. Description of the Related Art

Securing hair ornaments through use of a hair bands, combs, hairpins, barrettes, loops, styling devices, etc. is well known. Such devices often also serve the purpose of controlling or holding the user's hair in place, besides providing adornment. Such devices may also facilitate arrangement of the user's hair in a particular way to accomplish a desired style.

Most of the above-mentioned prior art hair devices generally required long hair for attachment thereto. Some devices looped around a bundle of hair, and were held on to long strands of hair. The hair band devices relied upon pressure against the user's head to remain in place. The attaching structure for the barrette, hairpin and comb devices was typically unattractive, such that attempts were being made to camouflage or hide that structure.

McKeown, U.S. Pat. No. 5,706,836 is representative of the prior art. McKeown disclosed a variety of hair ornament and hair control devices, providing ornamentation and attachablity to a user's hair. Typical of the prior art, McKeown disclosed large ornaments using headbands, combs, barrettes, etc. as attaching structure.

Hook-and-loop fastening systems sold under the trademark Velcro® are in widespread use on numerous consumer products, including fashion accessories. Commonly, in the prior art, half of the Velcro® fastener is glued to something attached to the user's body, and the other half is glued to an interchangeable ornament, such that the ornament may be easily changed out for a number of different looks. Velcro® is also utilized by McKeown, but it is the loop side within the attaching structure which contacts the woman's hair.

Although the prior art devices had proven generally suitable for their intended purposes, they possessed inherent deficiencies which detracted from their effectiveness. is The prior art required large clips and long hair to attach ornamentation to women's hair. The clips were unattractive, and not useable by the many women with short hair. The hair bands placed undesirable pressure against the user's head and were even known to cause headaches.

Regarding the use of the Velcro® hook-and-loop fastening system in conjunction with hair ornaments, use of both sides of the Velcro® also added bulk to the ornaments.

OBJECTS OF THE INVENTION

Accordingly, it is an object of the present invention to provide lightweight ornaments attachable directly to the user's hair.

It is a further object of the invention that the ornament not include any large or bulky attaching structure.

It is a still further object of the invention that the ornament be attachable to short hair as well as long hair.

It is a yet further object of the invention that the user be able to wear the ornament without being consciously aware of its presence.

These and other objects and advantages of the present invention will be apparent from a review of the following specification and accompanying drawings.

SUMMARY OF THE INVENTION

The present invention specifically addresses the above-mentioned deficiencies of the prior art, and meets the objects of the invention also mentioned above.

An adornment for attachment to a user's hair includes a cloth fabric piece having a decorative side and a back side, the back side having a Velcro® hook fastener portion attached hereto. The hook fastener portion may be intertwined with the user's hair, thereby attaching the adornment and displaying its decorative side.

The cloth fabric is preferably silk, and the decorative side has the appearance of a flower such as a daisy or a rose. The decorative side may alternatively have the appearance of a bumble bee, butterfly, or the like.

The diameter of the cloth fabric piece is about 1 inch or less, and the cloth fabric piece is very lightweight. On the back side of the ornament, the hook fastener portion is generally round in shape, the diameter less than the diameter of the cloth fabric piece.

The adornment for attachment to a user's hair may alternatively include a plastic piece having the appearance of a rare gemstone, with a crown side and a back side, again the back side having a hook fastener portion attached. The hook fastener portion may similarly be intertwined with the user's hair, thereby attaching the adornment and displaying the crown side.

The plastic piece is preferably generally round and has a diameter of approximately ¼ inch or less, and is very lightweight. On the back side, the hook fastener portion is generally round in shape, its diameter less than that of the lightweight piece.

Other alternate embodiments of the invention include drop or dangling adornments. These are constructed of a fibered material having a one- or two-sided hook fastener portion(s) at at least one end thereof. The hook fastener portion(s) is/are similarly intertwined among the user's hair to attach the same, and display the fibered material onto which small beads or other decorative material may be strung.

BRIEF DESCRIPTION OF THE DRAWINGS

FIG. 1 is a perspective view of hair ornaments attached in a woman's hair in accordance with the present invention;

FIG. 2 is a front perspective view of a preferred embodiment of the present invention wherein the ornamentation is a bumblebee;

FIG. 3 is a front perspective view of a preferred embodiment wherein the ornamentation is a daisy flower;

FIG. 4 is a front perspective view of an alternate embodiment of the present invention wherein the ornamentation has the appearance of a gemstone;

FIG. 5 is a front perspective view of a preferred embodiment wherein the ornamentation is a rose flower;

FIG. 6 is a rear perspective view of the daisy flower embodiment as attached to several strands of hair;

DESCRIPTION OF THE PREFERRED EMBODIMENTS

Figure 7:
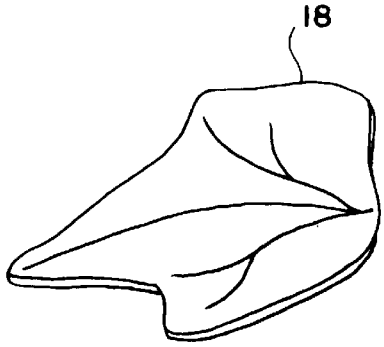
FIG. 7 is a front perspective view of a preferred leaf embodiment.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The hair ornament attachment system of the present invention is illustrated in FIGS. 1–10, which depict several embodiments of the invention.

First referring to FIG. 1, illustrated are several hair ornaments 10 attached to a woman's hair. In accordance with the present invention, many hair ornaments may be attached at a time, or only one or two each of the days of the month, depending upon the user's preferences. Additionally, although the woman shown has relatively long hair, the present invention is also suitable for use by women with short hair.

FIGS. 2, 3, 5 and 7 show enlarged front-side perspective views of several preferred hair ornaments, including bumble-bee 12, daisy flower 14, rose bud 16, and leaf 18 embodiments. A butterfly embodiment 19, as shown in FIG. 1 is contemplated. Other embodiments not shown are also contemplated, including raspberries, strawberries, other flowers, etc. Each of these preferred ornaments are constructed of thin, lightweight fabric such as silk. Various colors of silk are used to add to the visual appeal of the ornaments. The ornaments are generally small in size, from approximately ½ inch to 2 inches, although most are less than one inch in diameter. The ornaments weigh less than approximately one ounce.

Figure 8:
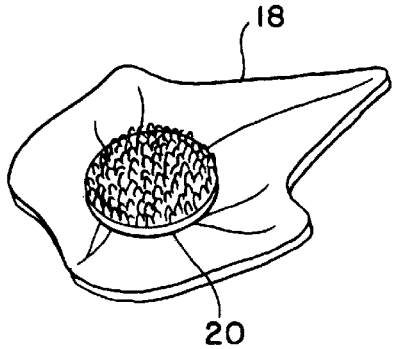
FIG. 8 is a rear perspective view of the back side of the leaf embodiment showing the Velcro® hook portion.

Now referring to FIG. 8, shown is the back side of the leaf ornament 18. Adhered thereto is the hook portion 20 of a conventional hook-and-loop or Velcro® attachment system. Preferably the hook portion 20 is of a round shape, and smaller than the size of the ornament 18. Each of the hair ornaments of the present invention is similarly Velcro®-backed, e.g., the back side of the daisy flower ornament 14 has adhered thereto the hook portion 20 of the hook-and-loop attachment system (see FIG. 6).

Next referring to FIG. 4, shown is an alternate embodiment wherein the ornament 22 is constructed of a piece of plastic, having a crown side formed to resemble a rare gemstone (e.g., a brilliant diamond, emerald, ruby, etc.) The crown preferably includes a reflective backing which adds sparkle in the light. This ornament 22 is about ¼ inch in diameter and weighs less than approximately one ounce. Again, adhered to the backside is a small (less than ¼ inch diameter) Velcro® hook portion 20.

Figure 9:
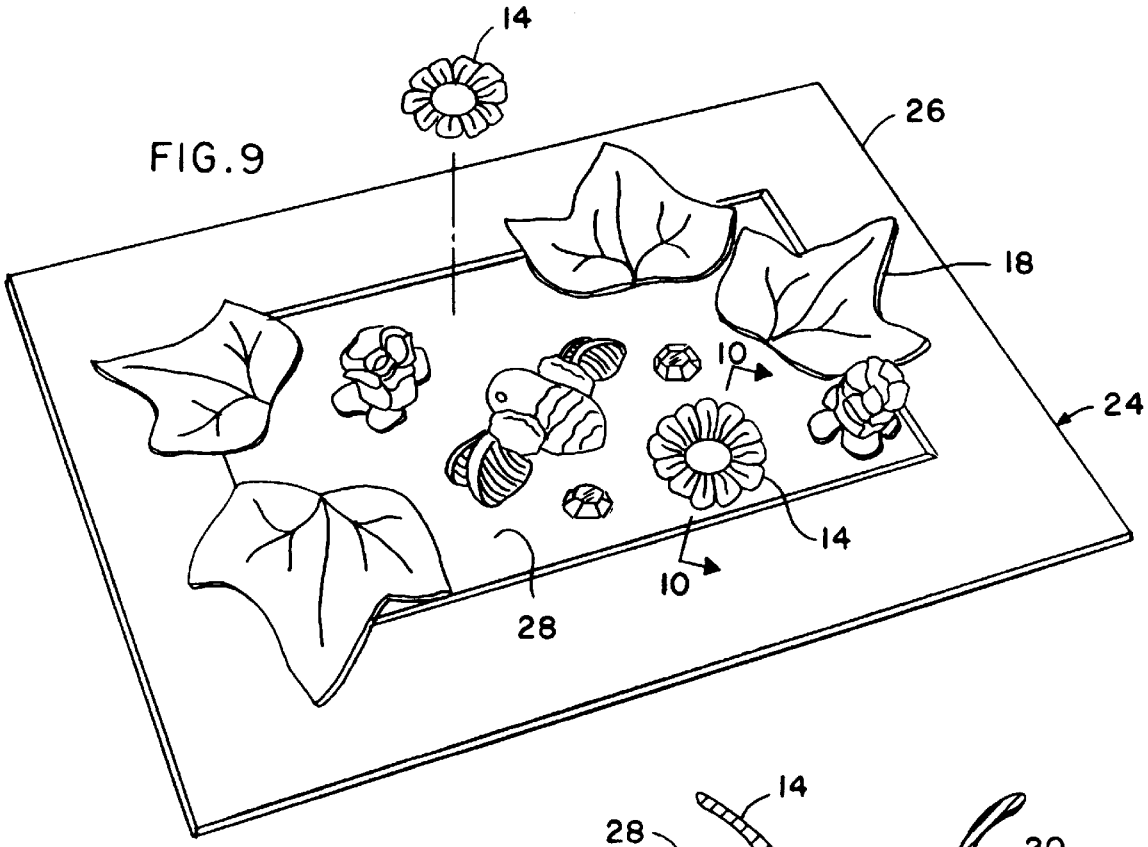
FIG. 9 is a front perspective view of several of the embodiments as displayed in its picture frame display.
Figure 10:
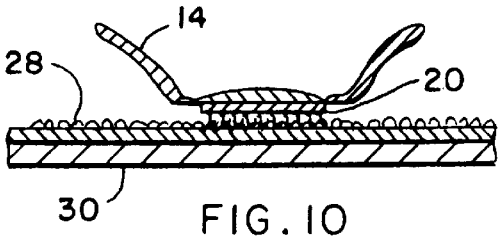
FIG. 10 is a section view of the daisy flower embodiment as attached to the display.

Finally, FIGS. 9 and 10 show the preferred display 24 for a collection of hair ornaments inside a rigid frame 26, and adhered to a rigid backing 30 is a large Velcro® loop fastening area 28. Each of the ornaments, such as the daisy ornament 14, are attached to the display 24 by mating the hook fastener back portion 14 with the loop fastening area 26. This display 24 conveniently holds a large number of ornaments when they are not in use, preventing them from getting lost or damaged. The display 24 may optionally include a conventional fold out stand (not shown), such that the display may sit upright like a propped up picture frame rather than flat.

Having described the structure of the hair ornaments 10 and display 24, it is possible to describe their use. The hair ornaments 10 are purchased inside packaging adhered to loop area 28 of the display 24. The user selects an ornament 10 and removes it from the display 24, and slides its back side along a short distance next to several strands of her (or his) hair. The Velcro® hook portion 20 catches in the user's hair, and adheres the ornament 10 thereto. The round-shaped hook portion 20 was found most effective for attaching the ornament 10, there being no sharp corners to catch in the user's hair rather than the hook portion 20.

The small and lightweight hair ornament 10 is securely attached to the user's hair, with the user hardly aware it is there. The desired adornment is provided. To remove the ornament 10, the process is reversed, namely forcefully sliding the ornament 10 along the user's hair until the hook portion 20 disengages, and reattaching the backside of the ornament 10 to the loop area 28 of the display 24.

Figure 11:
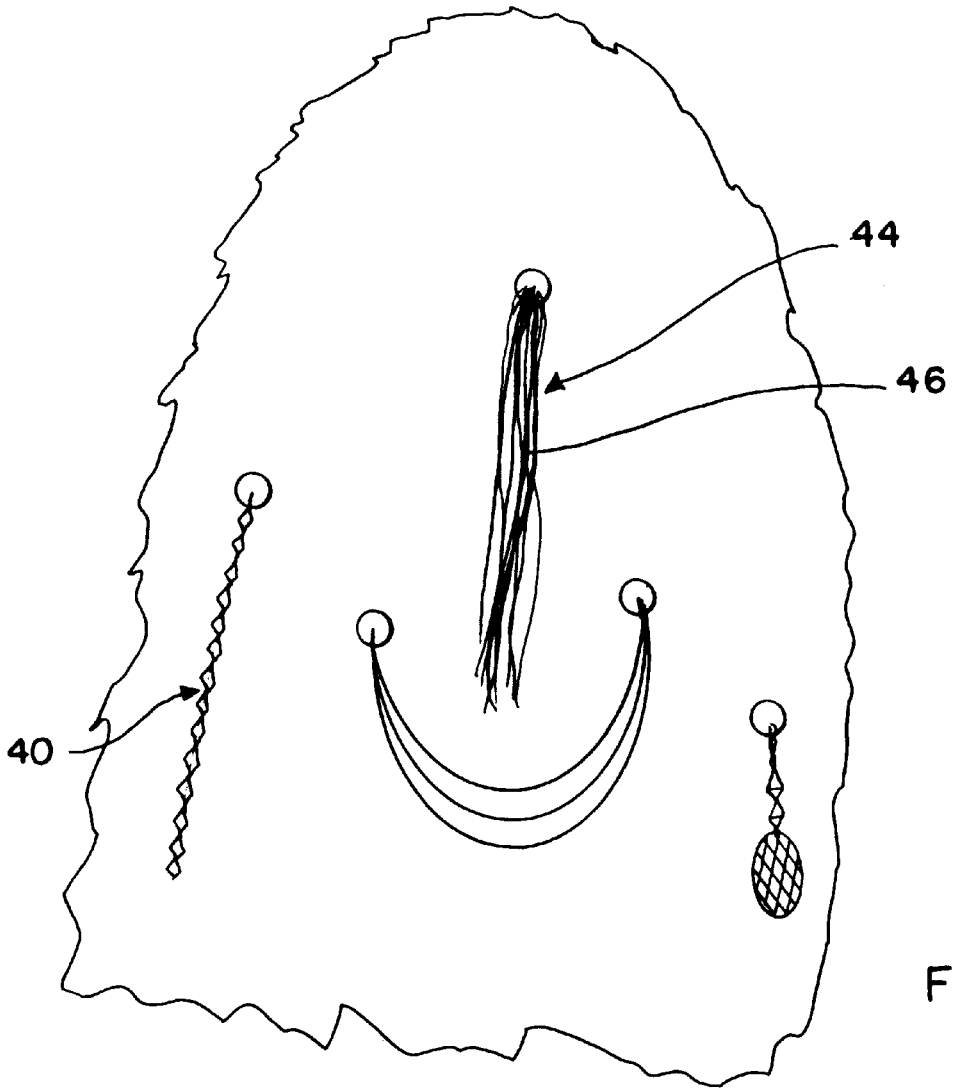
FIG. 11 is a perspective view of hair ornaments attached in the back side of a woman's hair in accordance with alternate embodiments of the present invention, the woman's hair covering the hook fastening portions.

Additional embodiments of the invention are depicted in FIGS. 11–16. First referring to FIG. 11, depicted are several drop or dangling-style hair ornaments 40 attached to the user's hair. The outer layer of the user's hair covers the hook fastening portions (not shown) which attach the ornaments 40 to underlying hair. Generally, as described below, several strands of the user's hair are placed over the hook fastening portions to conceal the same from view.

Figure 12:
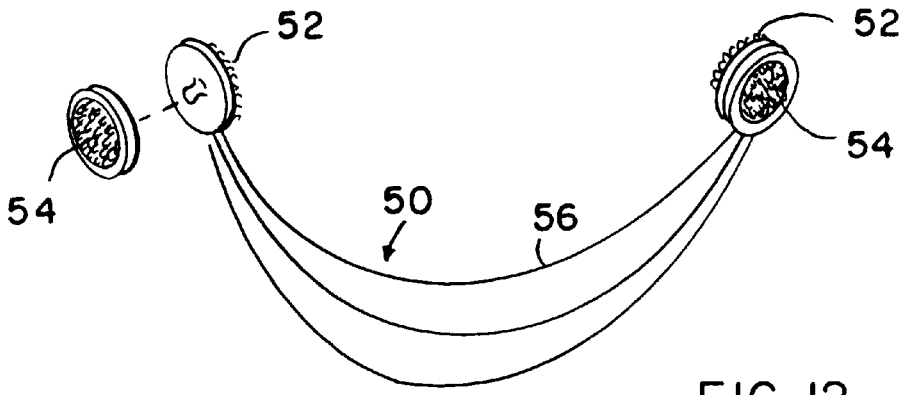
FIG. 12 is an exploded perspective view of an alternate embodiment with a snap attachment between the hook fastening portions.
Figure 13:
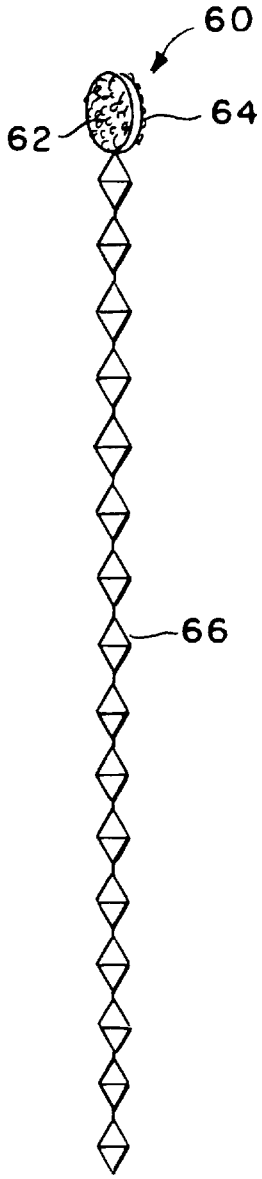
FIGS. 13 and 14 are perspective views of additional alternate embodiments with the snap attachment between the hook fastening portions.
Figure 14:
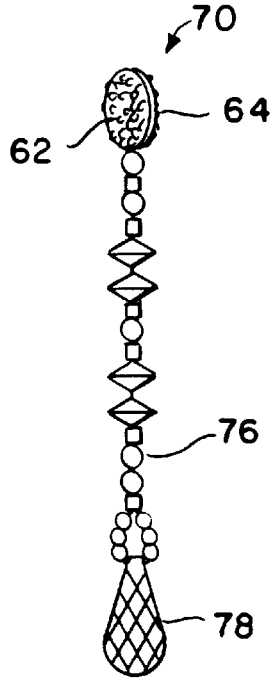
Figure 15:
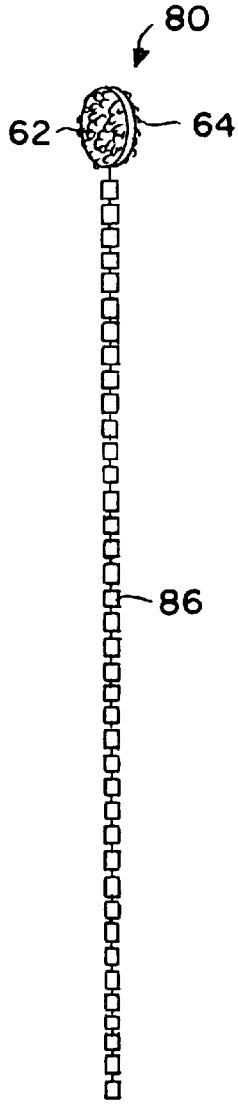
FIGS. 15 and 16 are perspective views of additional alternate embodiments with two-sided hook fastening portions.
Figure 16:
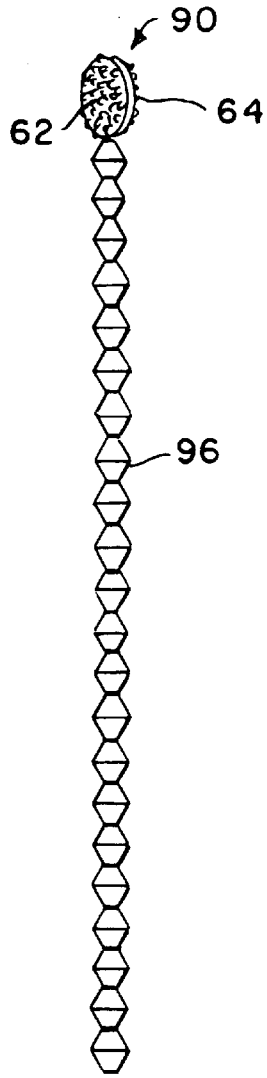

Referring to FIG. 12 a specific embodiment hair ornament 50 is shown. This hair ornament includes back-to-back hook fastening portions 52, 54 which snap together, on both ends of the ornament 50. Alternatively, the back-to-back hook fastening portions 52, 54 could be reasonably held together with a conventional hook and loop fastener (not shown). Between the ends are fibered materials onto which a multiplicity of beads 56 are strung on a number of strands of the fibered materials. The bead type and size can vary widely, so long as the beads are generally lightweight.

Next referring to FIGS. 13–16, additional embodiments of hair ornaments are shown, each of these having hook fastener portions on only one end of the ornament. Hair ornaments 60, 70, 80, 90 include the same back-to-back hook fastener portions 52, 54 which include a single string of beads 66, 76, 86, 96 respectively. Attached to the loose end of hair ornament 70 is a larger bead 78, which serves to weigh down that end of the ornament so it is less apt to fly around as the user moves his or her head. Alternatively, any of the hair ornaments 40 can be weaved into the outer layers of the user's hair to better stay in place, if desired.

FIGS. 13–16 show hair ornaments 60, 70, 80, 90 having back-to-back hook fastener portions 82, 84 which are glued together. Alternatively, any of these drop or dangling style hair ornaments 40 could include only single hook fastening portions on one or both ends, although the back-to-back configurations 52, 54 or 62, 64 are preferred since they provide more attaching surfaces.

Additional alternate embodiments are also contemplated. For example, hair ornament 44 includes several strands of artificial hair 46, preferably of a color contrasting a typical user's hair.

Use of these drop or dangling-style hair ornaments 40 is now described. The ornaments 40 may be selected from the loop area 28 of display card 24 packaging as described above. Then the back-to-back hook fastener portions (e.g. 62, 64) are placed between several strands of the user's hair, and the hook fastener portions are slid a short distance thereby catching the hair therein and concealing the hook fastener portions. The hook portions serve as the sole point of attachment of the hair ornament.

For the hair ornament 50 which has a second hook fastening portion on the opposing end, the installation procedure described above is repeated for the opposing end. Once installed, the hook fastening portions 52, 54 or 62, 64 support the hair ornament suspended therebetween. For the hair ornament 50 employing the releasable snap connection between the back-to-back hook fastening portions 52, 54, it is possible to strengthen the installation by placing several strands of the user's hair between the snap.

It is understood that the exemplar hair ornament attachment system described herein and shown in the drawings represents only presently preferred embodiments of the invention. Indeed, various modifications and additions may be made to such embodiments without departing from the spirit and scope of the invention. These and other modifications and additions may be obvious to those skilled in the art and may be implemented to adapt the present invention for use in a variety of different applications.

What is claimed is:

1. An adornment for attachment to a user's hair comprising:

a fibered material having one end mounted to a hook fastener portion, such that only the hook fastener portion may be intertwined with the user's hair serving as a sole point of attachment between the adornment and the user's hair, thereby attaching and displaying the ornament:

wherein both ends of the fibered material are mounted to a separate hook fastener portion.

2. The adornment of claim 1 further comprising a second hook fastener portion attached back-to-back to the other hook fastener portion.

3. The adornment of claim 2 wherein the two hook fastener portions are releasably attached to one another.

4. A method for attaching an adornment to a user's hair comprising:

providing a fibered material having one end attached to a pair of hook fastener portions mounted back-to-back;

placing the hook fastener portions between several strands of the user's hair, serving as a sole point of attachment to the user's hair; and sliding the hook fastener portions along the several strands a short distance, thereby attaching the hook fastener portions to the user's hair.

5. A method for attaching an adornment to a user's hair comprising:

providing a fibered material having one end mounted to a hook fastener portion;

placing only the hook fastener portion against several strands of the user's hair serving as a sole point of attachment to the user's hair;

sliding the hook fastener portion along the several strands a short distance, thereby attaching the hook fastener portion to the user's hair; and moving several other strands of the user's hair over the hook fastener portion thereby concealing the same.

6. The method of clam 5 wherein a second hook fastener portion is mounted to an opposing end of the fibered material, and further comprising:

placing the second hook fastener portion against several strands of the user's hair serving as a sole point of attachment to the user's hair;

sliding the second hook fastener portion along the several strands a short distance, thereby attaching the hook fastener portion to the user's hair and suspending the fibered material between the hook fastener portions; and moving several other strands of the user's hair over the second hook fastener portion thereby concealing the same.

7. A method for attaching an adornment to a user's hair comprising:

providing a fibered material with one end attached to a first hook fastener portion having a front side and a back side;

providing a second fastener portion releasably attachable backside-to-backside to the first hook fastener portion;

placing several strands of the user's hair between the hook fastener potion back sides;

placing several strands of the user's hair against the first hook fastener portion front side; and placing several strands of the user's hair against the hook fastener portion against the second hook fastener portion front side;

whereby, the hair adornment is attached to the user's hair and the hook fastener portions concealed.

* * * * *